US006478383B1

(12) United States Patent
Ojanen et al.

(10) Patent No.: US 6,478,383 B1
(45) **Date of Patent: *Nov. 12, 2002**

(54) ROTATABLE CUTTING TOOL-TOOL HOLDER ASSEMBLY

(75) Inventors: Randall W. Ojanen, Bristol, TN (US); Kirk E. Webb, Harrison, TN (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/420,026

(22) Filed: Oct. 18, 1999

(51) Int. Cl.[7] ..... E21C 35/18

(52) U.S. Cl. ..... 299/104; 299/106; 299/111

(58) Field of Search ..... 299/79.1, 104, 299/106, 107, 110, 111

(56) References Cited

U.S. PATENT DOCUMENTS

| | | | | |
|---|---|---|---|---|
| 2,730,344 A | | 1/1956 | Cartlidge | |
| 3,519,309 A | | 7/1970 | Engle et al. | |
| 3,752,515 A | | 8/1973 | Oaks et al. | 287/52 |
| 3,796,464 A | | 3/1974 | Hansen et al. | 299/86 |
| 3,865,437 A | | 2/1975 | Crosby | 299/86 |
| 4,014,395 A | | 3/1977 | Pearson | 175/410 |
| 4,084,856 A | | 4/1978 | Emmerich et al. | 299/86 |
| 4,201,421 A | | 5/1980 | Den Besten et al. | 299/86 |
| 4,247,150 A | | 1/1981 | Wrulich et al. | 299/86 |
| 4,484,783 A | | 11/1984 | Emmerich | 299/86 |
| 4,561,698 A | | 12/1985 | Beebe | 299/86 |
| 4,603,911 A | | 8/1986 | Hindmarsh et al. | 299/91 |
| 4,621,871 A | * | 11/1986 | Salani | 299/79.1 |
| 4,660,890 A | | 4/1987 | Mills | 299/79 |
| 4,684,176 A | | 8/1987 | Besten et al. | 299/91 |
| 4,728,153 A | | 3/1988 | Ojanen et al. | 299/92 |
| 4,755,003 A | | 7/1988 | Pinkerton et al. | 299/86 |
| 4,818,027 A | | 4/1989 | Simon | 299/92 |
| 4,823,454 A | | 4/1989 | Mills | 29/437 |
| 4,844,550 A | | 7/1989 | Beebe | 299/92 |
| 4,932,723 A | | 6/1990 | Mills | 299/86 |
| 4,938,538 A | | 7/1990 | Larsson et al. | 299/86 |
| 5,018,793 A | | 5/1991 | Den Besten | 299/86 |
| 5,219,209 A | | 6/1993 | Prizzi et al. | 299/86 |
| 5,261,499 A | | 11/1993 | Grubb | 175/427 |
| 5,374,111 A | | 12/1994 | Den Besten et al. | 299/86 |
| 5,607,206 A | | 3/1997 | Siddle et al. | 299/102 |
| 6,000,153 A | * | 12/1999 | Sollami | 299/106 X |
| 6,113,195 A | * | 9/2000 | Mercier et al. | 299/104 |
| 6,244,665 B1 | | 6/2001 | Bise et al. | 299/106 |

FOREIGN PATENT DOCUMENTS

| | | |
|---|---|---|
| CA | 816565 | 7/1969 |
| DE | 3623958 | 1/1988 |
| SU | 373400 | 12/1973 |
| SU | 751991 | 7/1980 |

OTHER PUBLICATIONS

Pilkey, Walter, D., Formulas for stress, strain, and structural matrices, 1994, John Wiley and Sons, p 254.*

Sandvik Brochure "Drive Ahead with System 35" [4 pages] (1987).

(List continued on next page.)

*Primary Examiner*—Heather Shackelford
*Assistant Examiner*—John Kreck
(74) *Attorney, Agent, or Firm*—Kevin P. Weldon

(57) ABSTRACT

An assembly that includes a rotatable cutting tool and a tool holder. The rotatable cutting tool has an integral enlarged dimension portion mediate which has a periphery and a rearwardly facing surface which defines a generally planar shoulder. The tool holder includes a bore and has an integral mating surface which surrounds the forward end of the bore. The mating surface has a peripheral edge. The rotatable cutting tool is rotatably retained in the bore of the tool holder body so that the shoulder of the elongate cutting tool body contacts the mating surface of the tool holder body and the periphery of the enlarged dimension portion of the elongate cutting tool body extends radially outwardly past the peripheral edge of the mating surface.

6 Claims, 5 Drawing Sheets

OTHER PUBLICATIONS

Betek Brochure "With Betek Your Profit won't hang on a silk threat" [8 pages] date unknown.
Fansteel Catalog 803 "Construction Carbide Bits & Blocks" , p. 15 (1986).
Kennametal Catalog "Construction Tools" [20 pages] (1997) [B97–16(15)C7].
Kennametal Catalog, "Kennametal Construction Tooling Systems", [16 pages] (1985).
AMT Catalog, "Carbide Tools for the Road Construction Industry", [8 pages] date unknown.
Kennametal/AMT Brochure, "American Mine Tool's New Wide Collared Trenching Tools", [1 page] Date Unknown.
Kennametal/AMT Brochure for Blocks, [1 page] Date Unknown.
Wirtgen brochure for WV HD point attack tool [1 page] Date Unknown.
All Pacific Distribution brochure "Good Tools The Best" [2 pages] Date Unknown.
All Pacific Distribution brochure "Shield System", [2 pages] Date Unknown.
All Pacific Distribution Co. letter dated Apr. 9, 1985 [1 page].
All Pacific Distribution Reply Card, "Shield System" [2 pages] Date Unknown.
All Pacific Distribution brochure, "Spin Shield—Block Protector" [4page] Date Unknown.
All Pacific Distribution flyer "Shield System" [1 page] Date Unknown.
All Pacific Distribution flyer "Shank–Shield Bit" [1 page] Date Unknown.
All Pacific Distribution flyer "Spin Shield" [1 page] Date Unknown.
All Pacific Distribution flyer (OEM and Distributor Costs) "Shield Systems" [1 page] Date Unknown.
All Pacific Distribution flyer "Shield Systems" [1 page] Date Unknown.
All Pacific Distribution brochure "Shield Bit & Spin Shield" [2 page] Date Unknown.
All Pacific Distribution brochure "Tungsten Carbide Block Top–Pocket Saver" [2 pages] Date Unknown.
All Pacific Distribution brochure "Holder Protection" [2 pages] Date Unknown.

* cited by examiner

ROTATABLE CUTTING TOOL-TOOL HOLDER ASSEMBLY

FIELD OF THE INVENTION

The invention pertains to a rotatable cutting tool-tool holder assembly wherein the cutting tool rotates relative to the tool holder and the tool holder is attached to a driven member. More specifically, the invention pertains to a rotatable cutting tool-tool holder assembly wherein the cutting tool rotates relative to the tool holder (which is attached to a driven member) and the rotatable cutting tool experiences improved rotation, and thus longer tool life, as well as an enhanced ability to be removed from the tool holder.

BACKGROUND OF THE INVENTION

Over the years rotatable cutting tools have been used for many types of applications in which the cutting tool is used to impinge a substrate (or earth strata). Typically, the rotatable cutting tool has a hard cemented carbide insert at the forward end thereof and is rotatably retained adjacent the rearward end thereof by a tool holder so that the cutting tool rotates relative to the tool holder. The tool holder is attached to a driven member such as, for example, a chain, a wheel, or a drum. Typical applications for rotatable cutting tools include coal mining, trenching, drilling, road planning, and other applications where the rotatable cutting tool is driven so as to impinge an earth strata (e.g., coal, the ground, asphalt pavement, asphaltic concrete, concrete, or the like). The earth strata is broken and fractured upon the impact caused by the impingement of the rotatable cutting tool thereon so as to generate debris. This debris comprises large pieces or chunks of earth strata, as well as smaller pieces of earth strata and even very fine particles including dust-like particles of earth strata. The debris is being propelled at great velocities in the vicinity of the cutting tool and the tool holder.

Because of the severe environment in which a rotatable cutting tool-tool holder assembly may often operate (e.g., a road planning application or a coal mining application), the cutting tool is subjected to great forces. These forces can quickly destroy (or render ineffective) the cutting tool if the cutting tool fails to effectively rotate. It thus becomes very apparent that it is important to the successful and efficient usage of a rotatable cutting tool-tool holder assembly that the cutting tool consistently rotate throughout its operation.

Heretofore, the infiltration of debris between the cutting tool and the tool holder, i.e., the contamination of the interface between the cutting tool and the tool holder, has resulted in the ineffective rotation of the cutting tool, or in some cases the complete failure of the cutting tool to rotate. The ineffective rotation, or complete rotational failure of the cutting tool generally results in the severe uneven wear of the hard insert, and possibly the eventual dislodgement of the hard insert from the cutting tool body. Either one of the above results essentially terminates the useful life of the cutting tool.

In the past there have been attempts to limit the passage of debris to the interface between the cutting tool and the tool holder. For example, U.S.

Pat. No. 4,603,911 to Hindmarsh et al. disclosed the of a thrust ring that was positioned within a special enlarged diameter section of the bore in the tool holder. The thrust ring had a V-shaped forward surface that registered with a complementary channel in the cutting tool. The structure disclosed by U.S. Pat. No. 4,603,911 used a number of components so as to be relatively complex. The complexity of the Hindmarsh et al. structure would be a disadvantage due to the severe environment in which these tools typically operate. Sandvik Rock Tools has apparently marketed a product under the designation SYSTEM 35 (Sandvik brochure entitled "Drive Ahead with SYSTEM 35" with an apparent date of 1987) which according to Sandvik was covered by U.S. Pat. No. 4,603,911.

During the 1980's, Kennametal Inc. of Latrobe, Pa. 15650 introduced rotatable construction tools under the designations C3KLR and C3KBF that presented a somewhat enlarged diameter shoulder diameter. The C3KLR construction tool and the C3KBF construction tool each experienced somewhat improved rotational properties.

During the mid-1990's, American Mine Tool of Chilhowie, Va. introduced a tool holder under the designation CB783. The CB783 tool holder presented a seat diameter that was about the same size as the shoulder diameter of the rotatable cutting tool. The use of the CB783 tool holder, especially when used in conjunction with a M3 rotatable cutting tool, resulted in some improvement in the rotational properties of the cutting tool. Although the above documents and products comprised attempts to improve the rotational properties of rotatable cutting tools, problems with the rotation of the cutting tools still existed due to the contamination of the interface between the cutting tool and the tool holder.

It thus becomes apparent that it would be desirable to provide a rotatable cutting tool-tool holder assembly that would help prevent the infiltration of debris between the cutting tool and the tool holder so as to promote the efficient rotation of the cutting tool during operation and increase the useful tool life of the cutting tool. It would also be desirable to provide a rotatable cutting tool itself that would prevent the infiltration of debris between the cutting tool and the tool body during operation and increase the useful life of the cutting tool.

The severe environment in which rotatable cutting tools may operate may also result in difficulties connected with the removal of the worn cutting tools from their respective tool holders. In the case of a road planning application, the cutting tools may be in hard-to-reach locations on the road planing drum. Difficult-to-remove cutting tools located in difficult-to-reach locations on a road planing drum are particularly troublesome for the operator to remove. The additional time and effort necessary to remove these worn cutting tools results to a reduction in overall efficiency of the road planing operation.

It thus becomes apparent that it would be desirable to provide a rotatable cutting tool-tool holder assembly that facilitates the removal of the worn cutting tools from their respective tool holders. It would also be desirable to provide a rotatable cutting tool itself that facilitates the removal of the cutting tool from the tool holder.

SUMMARY OF THE INVENTION

In one form thereof, the invention is an assembly of a rotatable cutting tool and a tool holder. The rotatable cutting tool includes an elongate tool body that has an axially forward end and an axially rearward end, a longitudinal axis, an integral head portion adjacent to the axially forward end, an integral shank portion adjacent to the axially rearward end, and an integral enlarged dimension portion mediate of the head portion and the shank portion. The enlarged dimension portion of the elongate tool body has a periphery and a rearwardly facing surface defining a generally planar shoulder. The elongate tool body has a hard insert at the axially forward end thereof. The tool holder comprises a tool holder body that contains a bore that has a forward end and a rearward end. The tool holder body defines an integral mating surface surrounding the forward end of the bore. The mating surface has a peripheral edge. The shoulder has a first transverse dimension, and the mating surface has a second transverse dimension. The first transverse dimension is greater than the second transverse dimension. The rotatable cutting tool is rotatably retained in the bore of the tool holder body so that the shoulder of the elongate cutting tool body contacts the mating surface of the tool holder body and the periphery of the enlarged dimension portion of the elongate cutting tool body extends radially outwardly past the peripheral edge of the mating surface.

In another form thereof the invention is a rotatable cutting tool for use with a tool holder. The tool holder includes a tool holder body that contains a bore that has a forward end and a rearward end wherein the tool holder body defines a mating surface with a peripheral edge and a transverse dimension. The mating surface surrounds the forward end of the bore. The cutting tool comprises an elongate tool body that has an axially forward end and an axially rearward end, a longitudinal axis, an integral head portion adjacent to the axially forward end, an integral shank portion adjacent to the axially rearward end, and an integral enlarged dimension portion mediate of the head portion and the shank portion. The enlarged dimension portion of the elongate tool body has a periphery and a rearwardly facing surface that defines a generally planar shoulder. The elongate tool body has a hard insert at the axially forward end thereof. The shoulder has a transverse dimension that is greater than the transverse dimension of the mating surface. The rotatable cutting tool is rotatably retained in the bore of the tool holder body so that the shoulder of the elongate cutting tool body contacts the mating surface of the tool holder body and the periphery of the enlarged dimension portion of the elongate cutting tool body extends radially outwardly past the peripheral edge of the mating surface.

In still another form thereof the invention is an assembly of a rotatable cutting tool and a tool holder. The rotatable cutting tool includes an elongate tool body that has an axially forward end and an axially rearward end, a longitudinal axis, an integral head portion adjacent to the axially forward end, an integral shank portion adjacent to the axially rearward end, and an integral enlarged dimension portion mediate of the head portion and the shank portion. The enlarged dimension portion of the elongate tool body has a periphery and a rearwardly facing surface that defines a generally planar shoulder. The elongate tool body has a hard insert at the axially forward end thereof. The tool holder comprises a tool holder body, which has a top surface, that contains a bore with a forward end and a rearward end. A boss extends from the top surface of the tool holder body so as to define the forward end of the bore. The boss has an integral mating surface that surrounds the forward end of the bore. The mating surface has a peripheral edge. The shoulder has a first transverse dimension and the integral mating surface has a second transverse dimension wherein the first transverse dimension is greater than the second transverse dimension. The rotatable cutting tool is rotatably retained in the bore of the tool holder body so that the shoulder of the elongate cutting tool body contacts the integral mating surface of the boss and the periphery of the enlarged dimension portion of the elongate cutting tool body extends radially outwardly past the peripheral edge of the integral mating surface.

In still another form thereof, the invention is an assembly assembly of a rotatable cutting tool and a tool holder. The rotatable cutting tool has an elongate tool body that includes a forward end and a rearward end, a longitudinal axis, an integral head portion adjacent to the forward end, an integral shank portion adjacent to the rearward end, and an integral enlarged dimension portion mediate of the head portion and the shank portion. The enlarged dimension portion of the tool body has a periphery and a rearwardly facing surface that defines a generally planar shoulder. A hard insert is at the forward end of the tool body. The tool holder comprises a tool holder body that contains a tool holder bore with a forward end and a rearward end. The tool holder further comprises an elongate sleeve that has a sleeve bore with a forward end and a rearward end. The sleeve has an integral mating surface that surrounds the forward end of the sleeve bore. The mating surface has a peripheral edge. The shoulder has a first transverse dimension and the mating surface has a second transverse dimension wherein the first dimension is greater than the second transverse dimension. The elongate sleeve is retained within the bore of the tool holder. The cutting tool is rotatably retained within the sleeve bore of the sleeve so that the shoulder of the cutting tool body contacts the mating surface and the periphery of the enlarged dimension portion of the cutting tool body extends radially outwardly past the peripheral edge of the mating surface.

BRIEF DESCRIPTION OF THE DRAWINGS

Applicants now set forth a brief description of the drawing figures which form a part of this patent application.

DETAILED DESCRIPTION OF THE INVENTION

Figure 1:
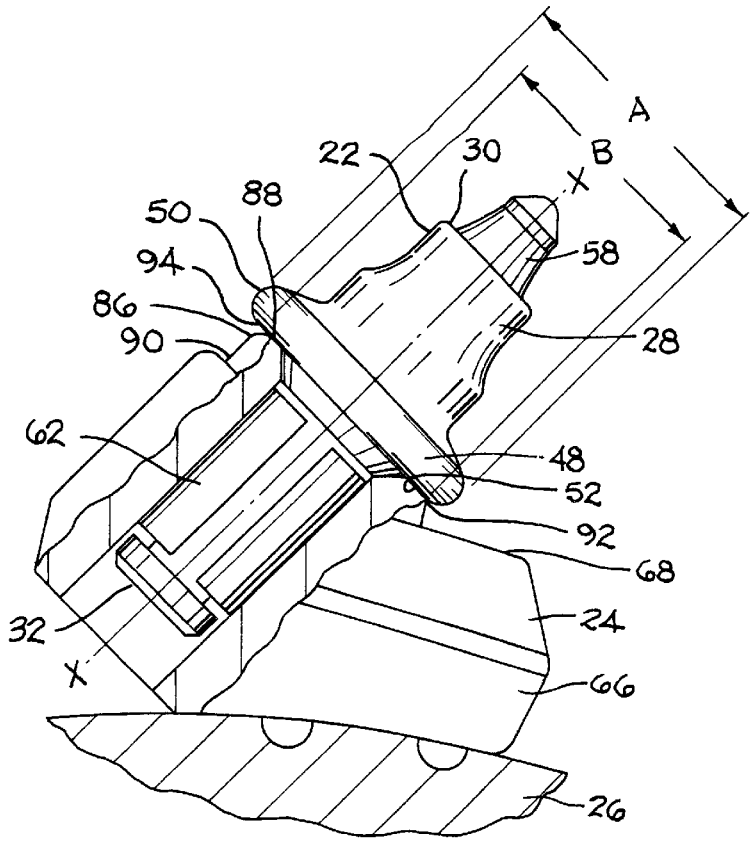
FIG. 1 is a side view of one specific embodiment of a rotatable cutting tool-tool holder assembly with a portion of the tool holder illustrated in cross-section, and wherein the cutting tool is rotatably retained within the bore of the tool holder.

Referring to the drawings, there is illustrated a first specific embodiment of a rotatable cutting tool-tool holder assembly generally designated as 20. The specific embodiment depicted in FIG. 1 illustrates a road planing tool;

however, this should not be considered to be limiting to the scope of the invention. Applicants consider the invention to be applicable to a wide range of rotatable cutting tools such as, for example, coal mining tools, trenching tools, drilling tools, as well as road planning tools.

Examples of cutting tools to which the present invention may be applicable are shown in Kennametal Catalog entitled "CONSTRUCTION TOOLS" [Catalog B97-16(15)C7] which was published in 1997 by Kennametal Inc. of Latrobe, Pa. and in American Mine Tool catalog "AMT Carbide Tools for the Road Construction Industry" which was published by American Mine Tool, a division of RTW, Inc. of Chilhowie, Va. 24319. Both of these catalogs are hereby incorporated by reference herein.

Rotatable cutting tool-tool holder assembly 20 includes a rotatable cutting tool 22 and a tool holder 24. In FIG. 1, the tool holder 24 is shown as being affixed by welding to the surface of a driven member 26; however, other ways (e.g., mechanical fasteners) to affix the tool holder to the driven member are contemplated to be within the scope of the invention. In the case of a road planing operation, the driven member 26 is a road planing drum.

Figure 3:
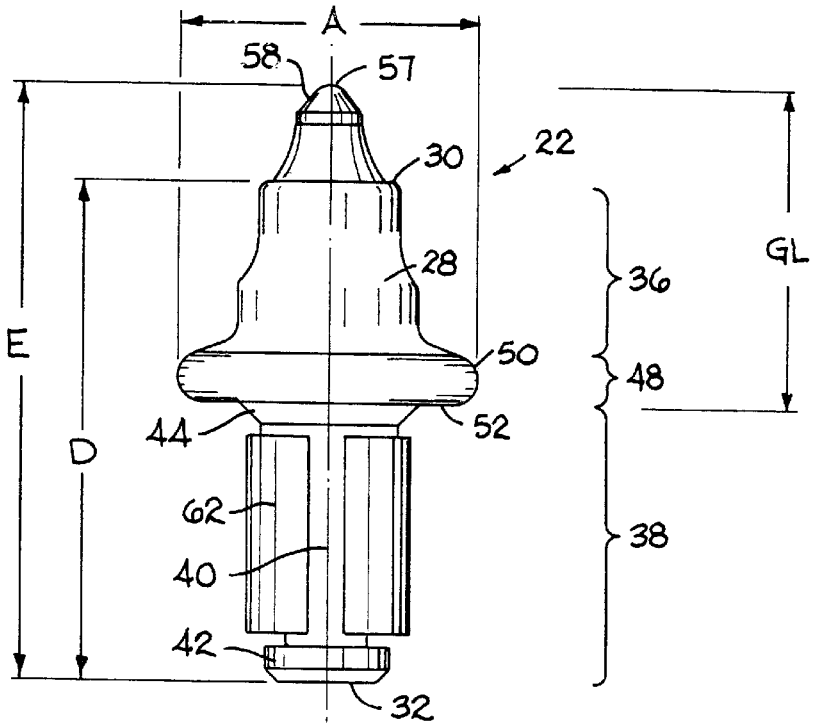
FIG. 3 is a side view of the rotatable cutting tool of FIG. 1.

Referring to the structure of the rotatable cutting tool 22 and especially FIG. 3, the cutting tool 22 includes an elongate tool body 28. The elongate tool body 28 is typically made of steel wherein the preferable grades of steel are AISI 4140 or a modified AISI 15B35 alloy wherein the hardness of these alloys ranges between about 40 and about 45 Rockwell C. The elongate steel body 28 has an axially forward end 30 and an axially rearward end 32. The elongate tool body 28 has a longitudinal axis x—x. The elongate tool body 28 may have a socket (not illustrated) at the axially forward end 30 thereof. The socket may be any one of a number of configurations such as, for example, the configurations shown and described in U.S. Pat. No. 4,216,832 to Stephenson, U.S. Pat. No. 4,497,520 to Ojanen, U.S. Pat. No. 4,725,099 to Penkunas et al., and U.S. Pat. No. 5,219,209 to Prizzi et al.

The elongate tool body 28 further includes a head portion (see bracket 36) adjacent to the axially forward end 30, as well as a shank portion (see bracket 38) adjacent to the axially rearward end 32 of the elongate tool body 28. The shank portion 38 presents a mediate reduced diameter portion 40 wherein there is a rearward abutment 42 at the rear end thereof and a frusto-conical forward abutment 44 at the forward end thereof.

The elongate tool body 28 further includes a mediate enlarged diameter (i.e., dimension) portion (see the bracket 48) that is mediate of the head portion 36 and the shank portion 38. The enlarged diameter portion 48 has a periphery (or peripheral edge) 50, as well as a rearwardly facing surface 52 that defines a shoulder. The enlarged diameter portion 48 of the elongate tool body 28 has a maximum diameter, i.e., the transverse dimension, called out in the drawings as dimension "A" (see FIGS. 1 and 3), which typically is less than the gauge length of the cutting tool. The gauge length is called out in FIG. 3 as dimension "GL" and is the distance between the rearwardly facing surface 52 of the mediate enlarged dimension portion 48 and axially forward end 57 of the hard insert 58. In the specific embodiment of FIGS. 1 and 3 the dimension "A" of the enlarged diameter portion 48 equals about 1.75 inches (4.45 centimeters [cm]) when the overall length "D" (see FIG. 3) of the tool body 28 is about 2.95 inches (7.49 cm). The overall length "E" (see FIG. 3) of the specific embodiment of the cutting tool 22 is about 3.51 inches (8.92 cm). The gauge length "GL" (see FIG. 3) of the specific embodiment is 1.86 inches (4.72 centimeters).

The cutting tool 22 also contains a hard insert 58 at the axially forward end thereof. The hard insert 58 typically mounts in the socket and is affixed to the elongate tool body 28 by brazing. The hard insert 58 is typically made from a cemented carbide material such as, for example, a cobalt-tungsten carbide alloy. Although the specific grade of cemented carbide depends upon the particular application for the cutting tool, rotatable cutting tools used in road planing applications may use a hard insert made of cobalt cemented tungsten carbide wherein the cobalt content ranges between about 5 weight percent to 13 weight percent with the balance comprising tungsten carbide. The hardness of the cemented tungsten carbide may range between about 86 and about 90.4 Rockwell A. A preferred grade of cemented tungsten carbide for a road planing application has a cobalt content that ranges between about 5.2 weight percent and about 6.3 weight percent with the balance being essentially tungsten carbide and the hardness ranging between 88.2 and 89.4 Rockwell A.

Like for the grade of cemented tungsten carbide, the specific braze alloy may vary depending upon the particular application. Exemplary braze alloys include copper-zinc-nickel-manganese-silicon braze alloys sold by Handy & Harman, Inc. 859 Third Avenue, New York, N.Y. 10022 under the designations HI TEMP 080 and HANDY HI-TEMP 548. U.S. Pat. No. 5,219,209 to Prizzi et al. sets forth a more detailed description of each one of these braze alloys. Two preferred braze alloys for road planing applications comprise either Nicumn 23 or Nicumn 37 each of which are sold by Wesgo. The composition of Nicumn 23 in weight percent is 67.5 percent copper, 23.5 percent manganese, and 9 percent nickel. The composition of Nicumn 37 (ASTM-4764) in weight percent is 52.5 percent copper, 38 percent manganese, and 9.5 percent nickel.

Still referring to the structure of the cutting tool, the elongate tool body 28 has a resilient retainer clip 62 retained within the reduced diameter portion 40 of the shank portion 38 thereof. The resilient retainer clip 62 is somewhat similar to the sleeve shown and described in U.S. Pat. No. 4,201,421 to Den Besten et al. for a MINING MACHINE BIT AND MOUNTING THEREOF (which is hereby incorporated by reference herein).

Figure 2:
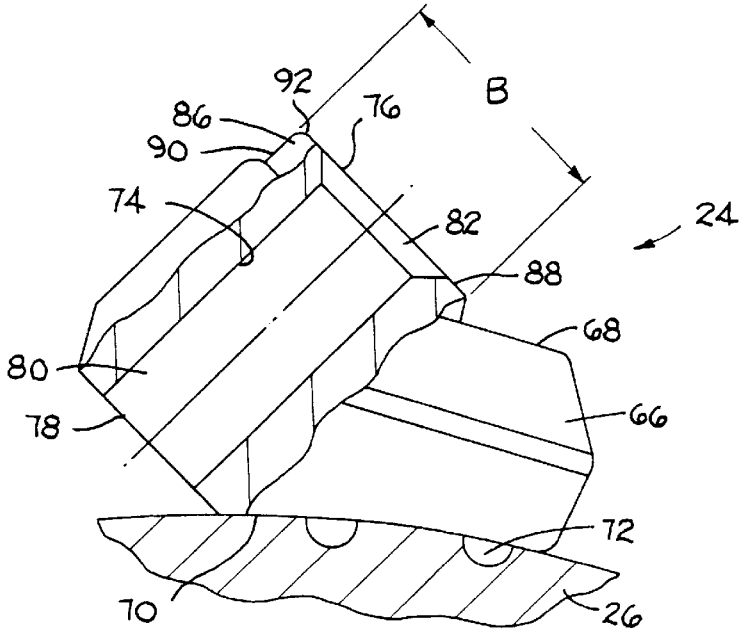
FIG. 2 is a side view of the tool holder of FIG. 1 with the portion thereof adjacent to the bore illustrated in cross-section.

Referring to the structure of the tool holder 24 and especially FIG. 2, the tool holder 24 has a tool holder body 66. The tool holder body 66 is made of steel wherein a preferred grade of steel is AISI 8740 which has a hardness ranging between about 45 and about 50 Rockwell C. The tool holder body 66 presents a structure along the lines of Block 775C as shown in the above-mentioned American Mine Tool catalog entitled "AMT Carbide Tools for the Road Construction Industry". Tool holder body 66 has a top surface 68 and a bottom surface 70. A plurality of projections 72 extend from the bottom surface 70. The purpose of these projections 72 is to mate with corresponding bores in the surface of a vane or base pad (or the like) 26, which is essentially a part of a driven member (e.g., a drum), so as to correctly position the tool holder 24 with respect to the driven member.

The tool holder body 66 further contains a generally cylindrical bore 74 that has a forward end 76 and a rearward end 78. A bore wall 80 defines the bore 74 and includes a frusto-conical section 82 at the forward end 76 of the bore 74.

The tool holder body 66 further has a generally cylindrical boss 86. The boss 86 projects from the top surface 68 of the tool holder body 66. The boss 86 presents a generally circular mating surface 88 that surrounds the opening at the forward end 76 of the bore 74. The mating surface 88 is generally planar. The boss 86 has a generally circular peripheral edge 90. The mating surface 88 also has a generally circular peripheral edge 92. The diameter, i.e., the transverse dimension, of the mating surface 88 is called out in the drawings (see FIGS. 1 and 2) as dimension "B". It is preferred that the transverse dimension "A" of the enlarged diameter portion 48 of the tool body 28 is at least about five percent greater than the transverse dimension "B" of the mating surface 88 of the tool holder body 66. Such is the case for the specific embodiment of FIGS. 1–3 wherein the dimension "B" of the mating surface equals about 1.515 inches (3.85 centimeters) when dimension "A" equals 1.75 inches (4.45 centimeters). Therefore, dimension "A" is about 16 percent greater than dimension "B".

As shown in FIG. 1, the rotatable cutting tool 22 is in the bore 74 of the tool holder 24. The cutting tool 22 is typically inserted into the bore 74 through the forward end 76 of the bore 74 by pounding the cutting tool with a mallet. As the rear shank portion 38 (along with the resilient retainer clip 62) passes into the bore 74, the retainer clip 62 is compressed so that it expands radially outwardly against the bore wall 80 so as to frictionally engage the bore wall 80. As shown and described in U.S. Pat. No. 4,201,421 to Den Besten et al., when the cutting tool 22 is fully positioned within the bore 74 of the tool holder 24, the rotatable cutting tool is securely retained within the bore 74 of the tool holder 24 in such a fashion that it can rotate relative to the tool holder 24.

When in the position illustrated in FIG. 1, the rearwardly facing surface 52 of the mediate enlarged dimension portion 48, i.e., shoulder, contacts the mating surface 88. Furthermore, when in the position illustrated in FIG. 1, the periphery 50 of the mediate enlarged diameter portion 48 extends radially outwardly past the peripheral edge 90 of the boss 86, as well as radially outwardly past the peripheral edge 92 of the mating surface 88.

In an application (e.g., a road planing application) in which a rotatable cutting tool impinges an earth strata (e.g., asphalt pavement or asphaltic concrete) so as to fracture and break the same there is generated debris. The ability to protect the interface between the shank portion (and retainer sleeve) of the cutting tool and the bore of the tool holder from contamination by the debris (and especially fine particle-like debris) is important to ensure adequate rotation of the cutting tool. The mediate enlarged diameter portion having a periphery that extends radially outwardly past the peripheral edge of the mating surface (as well as radially outwardly past the peripheral edge of the boss) acts as a barrier to the passage of debris into the bore of the tool holder. The result is that there is a great reduction in the amount of debris that contaminates the interface between the cutting tool and the tool holder. In addition, the boss 86 extends past the top surface 68 of the tool holder body 66. As a result of this extension, the boss 86 also acts as a barrier to the entry of debris into the bore 74 of the tool holder 24 so as to reduce the amount of contamination at the interface between the cutting tool and the tool holder. Such a reduction in the amount of contamination of the interface between the cutting tool and tool holder enhances the ability of the cutting tool to consistently rotate during operation. An improvement in rotation of the cutting tool results in an increase in the overall useful life of the cutting tool The area of the enlarged diameter portion 48 that extends radially outwardly past the peripheral edge 92 of the mating surface 88 of the boss 86 defines a generally circular lip 94 (see FIG. 1). This lip 94 provides a surface area that may be used to assist in the extraction or removal of the cutting tool 22 from the tool holder 24 since the lip 94 provides a surface against which a force may be exerted to remove the cutting tool 22 from the bore 74 of the tool holder 24. Thus, the rotatable cutting tool-tool holder assembly 20 reduces the effort needed to remove worn cutting tools from the tool holder, especially in the case of difficult-to-remove tools in difficult-to-reach locations on the driven member.

Figure 4:
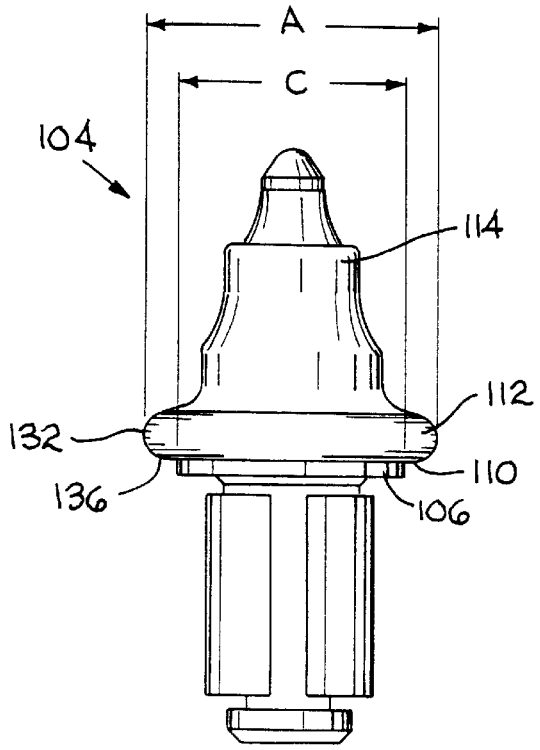
FIG. 4 is a side view of a second embodiment a rotatable cutting tool wherein the cutting tool includes a flat washer on the rearward shank adjacent to the rearwardly facing shoulder.
Figure 5:
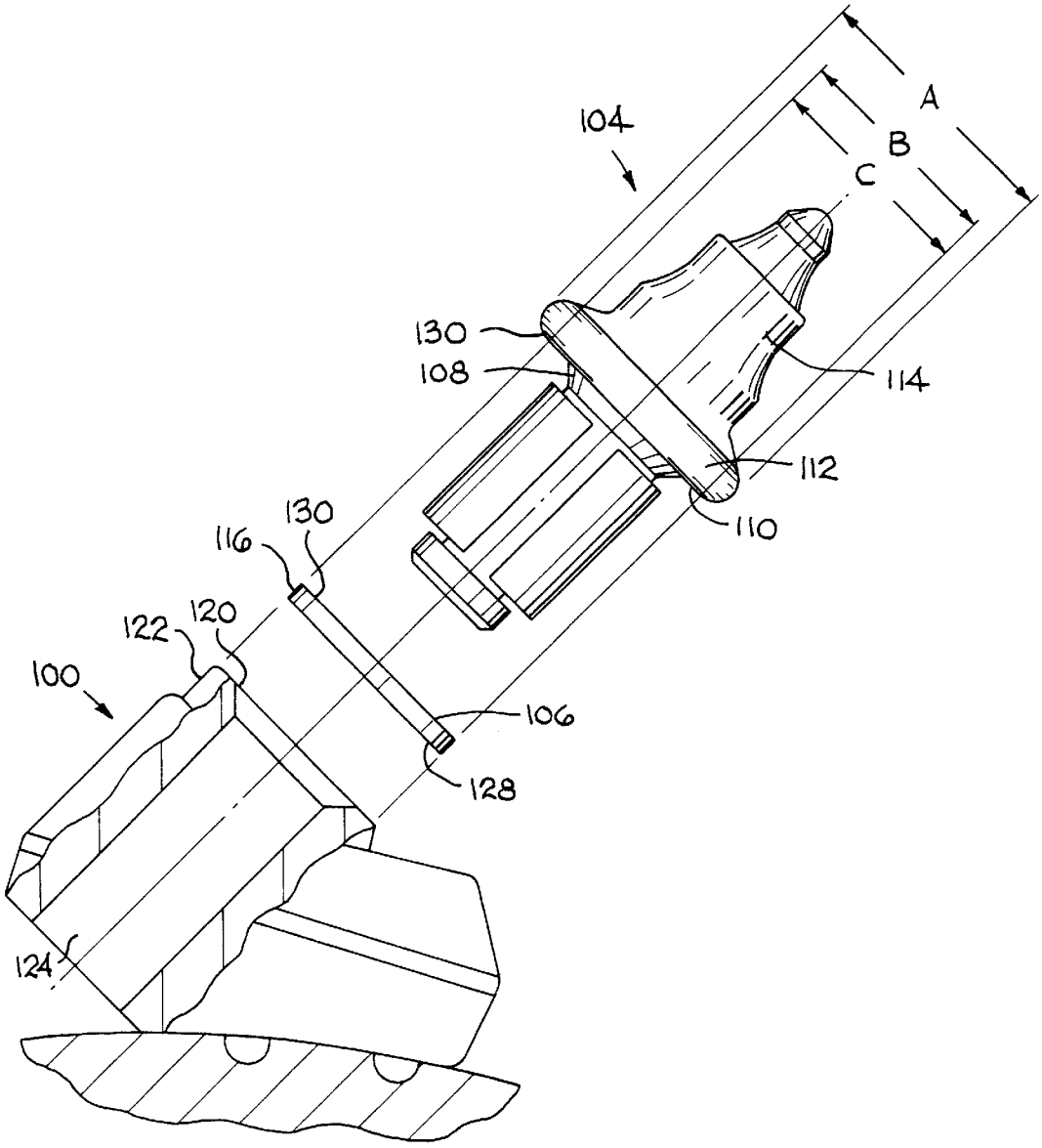
FIG. 5 is a side view of a rotatable cutting tool-tool holder assembly comprising the tool holder of FIG. 1 and the cutting tool of FIG. 4 wherein the washer and cutting tool are exploded away from the tool holder.

Referring to the specific embodiment of the cutting tool-tool holder assembly illustrated in FIGS. 4 and 5, there is shown a tool holder 100 that is structurally the same as the tool holder 24 of FIGS. 1 and 2 so that the description of tool holder 24 will suffice for a description of the tool holder 100. FIGS. 4 and 5 also show a rotatable cutting tool 104 that is structurally the same as the cutting tool 22 of FIGS. 1 and 3, except for the addition of a flat washer 106. Because of these structural similarities, the description of cutting tool 22 will suffice for the description of cutting tool 104, except for the description of the flat washer 106.

The washer 106, which has a central aperture, is positioned on the frusto-conical abutment 108 so as to be in contact with the rearwardly facing surface 110 of the enlarged diameter portion 112 of the cutting tool body 114. The washer 106 has a peripheral edge 116 that defines an outside diameter called out in FIGS. 4 and 5 as dimension "C". Dimension "C" is less than the transverse dimension "A" of the enlarged diameter portion 112 of the cutting tool body 114. Dimension "C" is about equal to or less than the transverse dimension "B" of the mating surface 120 of the boss 122 of the tool holder 110. Typically, it is preferred that dimension "A" is at least about five percent greater than the dimension "C" of the washer.

When the rotatable cutting tool 104 that carries the washer 106 is fully positioned within the bore 124 of the tool holder 100, the rearwardly facing surface 128 of the washer 106 abuts against the mating surface 120 of the boss 122. The forwardly facing surface 130 of the washer 106 abuts against the rearwardly facing surface 110 of the enlarged diameter portion 112 of the elongate tool body 114. Furthermore, the enlarged diameter portion 112 has a periphery 132 that extends radially outwardly past the peripheral edge 134 of the mating surface 120, as well as the peripheral edge 136 of the boss 122. Finally, it should be appreciated that the rearwardly facing surface 110 of the enlarged diameter portion 112 is spaced a distance apart from the mating surface 120. This distance is equal to the thickness of the washer 106.

The same advantages exist with the cutting tool and cutting tool-tool holder assembly of FIGS. 4 and 5 as exist for the cutting tool and cutting tool-tool holder of FIGS. 1–3. More specifically, the rotatable cutting tool 104 through the use of the enlarged diameter portion 112 provides a barrier to debris entering the bore 124 of the tool holder 100 and contaminating the interface between the shank portion (and retainer sleeve) of the cutting tool and the bore of the tool holder. The combination of the enlarged diameter portion 112 of the cutting tool 104 and the boss 122 of the tool holder 100 provides a barrier to the entry of debris into the bore 124 so as to protect against the contamination of the interface between the shank portion (and retainer sleeve) of the cutting tool and the tool holder. The presence of the lip 136, especially being spaced apart a distance equal to the thickness of the washer 106, from the mating surface 120 by the washer 106, enhances the ability to extract the cutting tool 104 from the tool holder 100.

Figure 6:
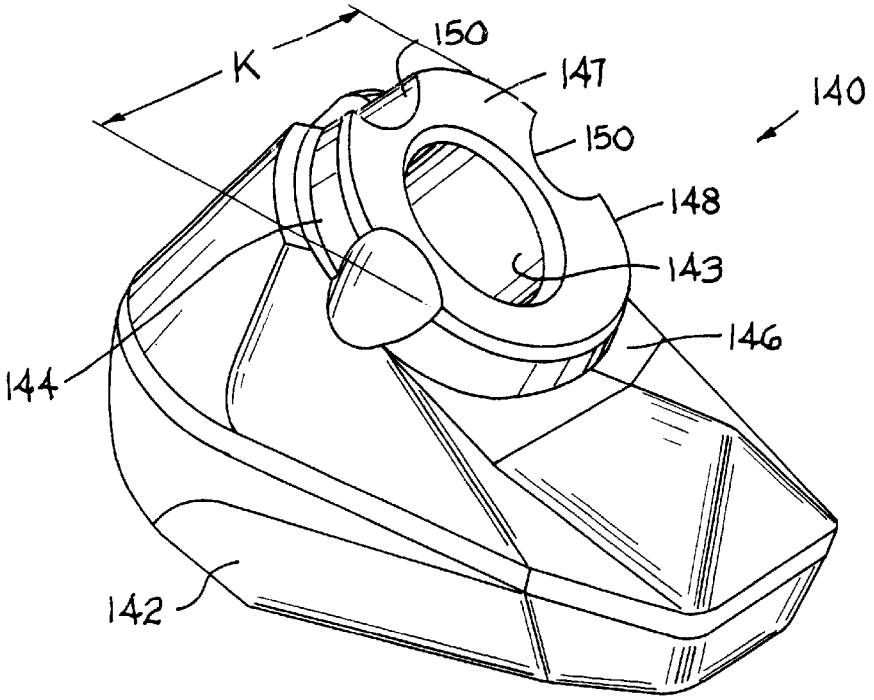
FIG. 6 is an isometric view of a second embodiment of a tool holder in which the boss contains a plurality of access grooves.

The specific embodiment of the tool holder as illustrated in FIGS. 1, 2 and 5 includes a boss which presents a generally planar (and smooth) mating surface as described hereinabove. It should be appreciated that the present invention is applicable for use with a tool holder that has a different style of boss. More specifically and referring to FIG. 6, the instant invention is applicable to the tool holder generally designated as 140. Tool holder 140 has a tool holder body 142 that contains a bore 143. The tool holder body 142 includes a boss 144 that projects from the top surface 146 of the tool holder body 142. The boss 144 presents a generally circular mating surface 147 that has a peripheral edge 148. The boss 144 further contains a plurality of access notches 150 which interrupt the generally circular nature of the peripheral edge 148 of the mating surface 146. The tool holder 140 illustrated in FIG. 6 is described in pending U.S. patent application Serial No. 09/251,566 filed on Feb. 17, 1999 by Bise et al. and assigned to Kennametal Inc. (the assignee of the present patent application), and this pending patent application is hereby incorporated by reference herein.

The tool holder 140 of FIG. 6 may replace the tool holders of the cutting tool-tool holder assemblies of FIGS. 1–3 and FIGS. 4–5. In this regard, the cutting tool of FIG. 1 can be used with the tool holder of FIG. 6, and the cutting tool of FIG. 4 can be used with the tool holder of FIG. 6.

Referring to the combination of the cutting tool 22 of FIG. 1 and tool holder 140, when the rotatable cutting tool 22 is positioned within the bore 143 of the tool holder 140, the rearwardly facing surface 52 of the mediate enlarged dimension portion 48 contacts the mating surface 147. The periphery 50 of the mediate enlarged dimension portion 48 extends radially past the peripheral edge 148 of the mating surface 147, as well as past the peripheral edge of the boss 144. The transverse dimension "A" of the enlarged dimension portion 48 should be at least about 5 percent as great as the transverse dimension of the mating surface 147, which is called out as dimension "K" in FIG. 6. In a specific embodiment, the dimension "A" equals about 1.75 inches (4.45 centimeters) and the dimension "K" equals about 1.515 inches (3.85 centimeters) so that dimension "A" is about 16 percent greater than dimension "K". The extension of the rearwardly facing surface 52 past the peripheral edge of the mating surface (and boss) provides a lip.

Referring to the combination of the cutting tool 104 of FIG. 4 and the tool holder 140, when the rotatable cutting tool 104 is positioned within the bore 143 of the tool holder 140, the rearwardly facing surface 128 of the washer 106 abuts against the mating surface 147 of the boss 144. The forwardly facing surface 130 of the washer 106 abuts against the rearwardly facing surface 110 of the enlarged dimension portion 112 of the cutting tool 104. The periphery 132 of the enlarged dimension portion 112 extends radially outwardly past the peripheral edge 148 of the mating surface 147, as well as the peripheral edge of the boss 144. The periphery 132 of the enlarged dimension portion 112 also extends radially outwardly past the peripheral edge of the washer 106. The transverse dimension of the enlarged dimension portion 112 of the cutting tool body should be at least about 5 percent greater than the transverse dimension of the mating surface 147. The extension of the rearwardly facing surface 110 past the peripheral edge of the mating surface (and the boss) provides a lip.

The advantages that exist for the assemblies of FIGS. 1–3 and FIGS. 4–5 still exist for the cutting tool-tool holder assemblies using the tool holder of FIG. 6, which comprise the assembly of the cutting tool of FIG. 1 with the tool holder of FIG. 6, and the assembly of the cutting tool of FIG. 4 with the tool holder of FIG. 6. More specifically, the boss of the tool holder and the enlarged dimension portion of the cutting tool body provide a barrier to the entry of debris into the bore of the tool holder so as to protect the interface between the cutting tool and the tool holder. The presence of the lip defined by the rearwardly facing surface of the enlarged dimension portion of the cutting tool body enhances the ability to remove the cutting tool from the tool holder. In this regard, the lip provides a surface against which to exert a force to remove the cutting tool from the bore of the tool holder. This is especially the case in light of the access grooves that expose even more surface area of the rearwardly facing surface of the enlarged dimension portion of the cutting tool body.

Figure 7:
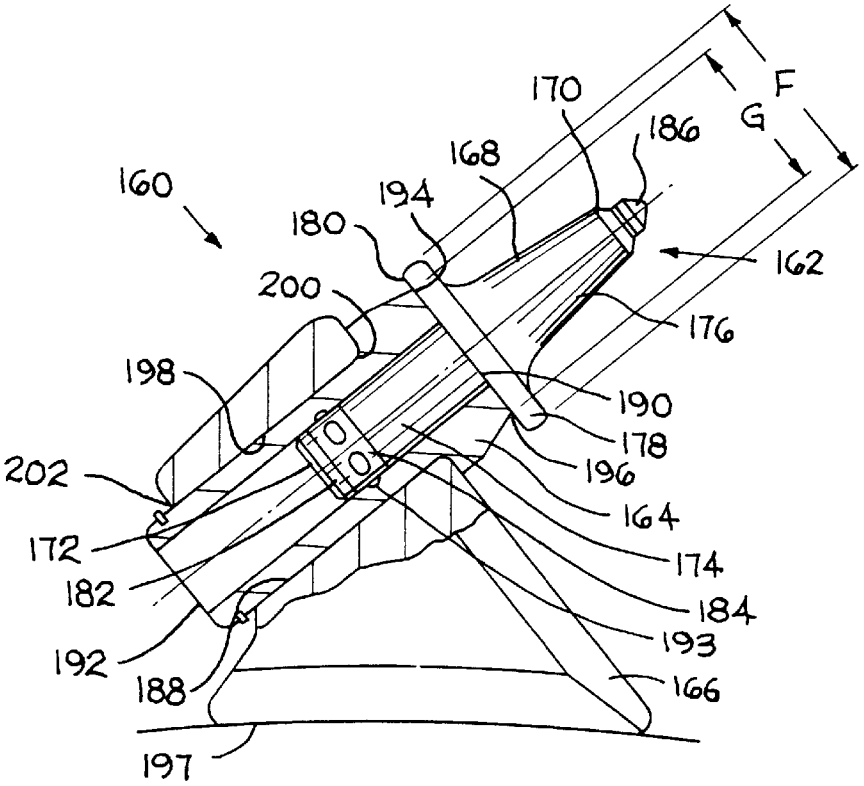
FIG. 7 is a side view of another specific embodiment of a rotatable cutting tool-tool holder assembly wherein the cutting tool is rotatably retained in a sleeve that is, in turn, retained within the bore of a tool holder.

FIG. 7 illustrates still another specific embodiment of a rotatable cutting tool-tool holder assembly generally designated as 160. The cutting tool-tool holder assembly 160 would be typically used for coal mining applications. The assembly 160 includes a rotatable cutting tool 162 and a generally cylindrical elongate sleeve 164. The cutting tool 162 is rotatably retained by the sleeve 164 (as will be discussed hereinafter). The cutting tool-tool holder assembly 160 further includes a tool holder 166 that retains the sleeve 164 (as will be discussed hereinafter).

Rotatable cutting tool 162 has a steel elongate tool body 168 with an axially forward end 170 and an axially rearward end 172. The tool body 168 further has a shank portion 174 adjacent to the rearward end 172 and a head portion 176 adjacent to the forward end 170.

The tool body 168 has an enlarged diameter (or dimension) portion 178 mediate of the head portion 176 and the shank portion 174. The enlarged dimension portion 178 has a rearwardly facing surface 180 that defines a shoulder. The enlarged dimension portion 178 has a transverse dimension "F" as shown in FIG. 7.

The shank portion 174 of the tool body 168 has a reduced diameter portion 182 which carries a resilient dimple clip 184 that has a structure along the lines of the dimple clip shown and described in U.S. Pat. No. 3,519,309 to Engle et al. and U.S. Pat. No. 3,752,515 to Oaks et al., each of which is hereby incorporated by reference herein.

There is a hard insert 186 at the forward end 170 of the tool body 168. The hard insert 186 is typically press-fit or brazed into a socket (not illustrated) at the forward end of the tool body 168. The hard insert 186 is typically made of a cemented carbide material that may vary with the specific application. The preferred compositions for the braze alloys and the hard insert of the cutting tool of FIG. 7 are described in U.S. Pat. No. 5,219,209 to Prizzi et al.

Still referring to FIG. 7, the assembly 160 also includes a steel elongate sleeve 164 that has a bore 188 with a forward end 190 and a rearward end 192.

The bore 188 has a channel 193 therein adjacent to the rearward end thereof. The sleeve 164 defines a generally circular mating surface 194 adjacent to the forward end of the bore 188. The mating surface 194 has a peripheral edge 196. The mating surface 194 has a transverse dimension "G".

The assembly 160 also includes the tool holder 166 which has a bottom surface 197 at which the tool holder 166 is mounted to a driven member (e.g., a chain). The tool holder 160 further contains a bore 198 with a forward end 200 and a rearward end 202.

The sleeve 164 is typically fixedly retained within the bore of the tool holder 166 so that the sleeve 164 does not rotate relative to the tool holder 166. However, it is possible that for certain applications the sleeve 164 may be rotatable with respect to the tool holder.

The cutting tool 162 is rotatably mounted within the bore 188 of the sleeve 164. The rearwardly facing surface 180 of the enlarged dimension portion 178 of the tool body contacts the mating surface 194 of the sleeve 164. It is typical that the transverse dimension "F" of the mediate enlarged dimension portion 178 is at least about five percent greater than the transverse dimension "G" of the mating surface 194.

The advantages that exist for the cutting tool-tool holder assembly 160 are basically the same as those advantages that exist for the cutting tool-tool holder assemblies of FIGS. 1–3 and of FIGS. 4–5. More specifically, the sleeve and the enlarged dimension portion of the cutting tool body provide a barrier to the entry of debris into the bore of the sleeve so as to protect the interface between the cutting tool and the sleeve. The presence of the lip defined by the rearwardly facing surface of the enlarged dimension portion of the cutting tool body enhances the ability to remove the cutting tool from the tool holder since the lip provides a surface against which to exert a force to remove the cutting tool from the bore of the sleeve.

Figure 8:
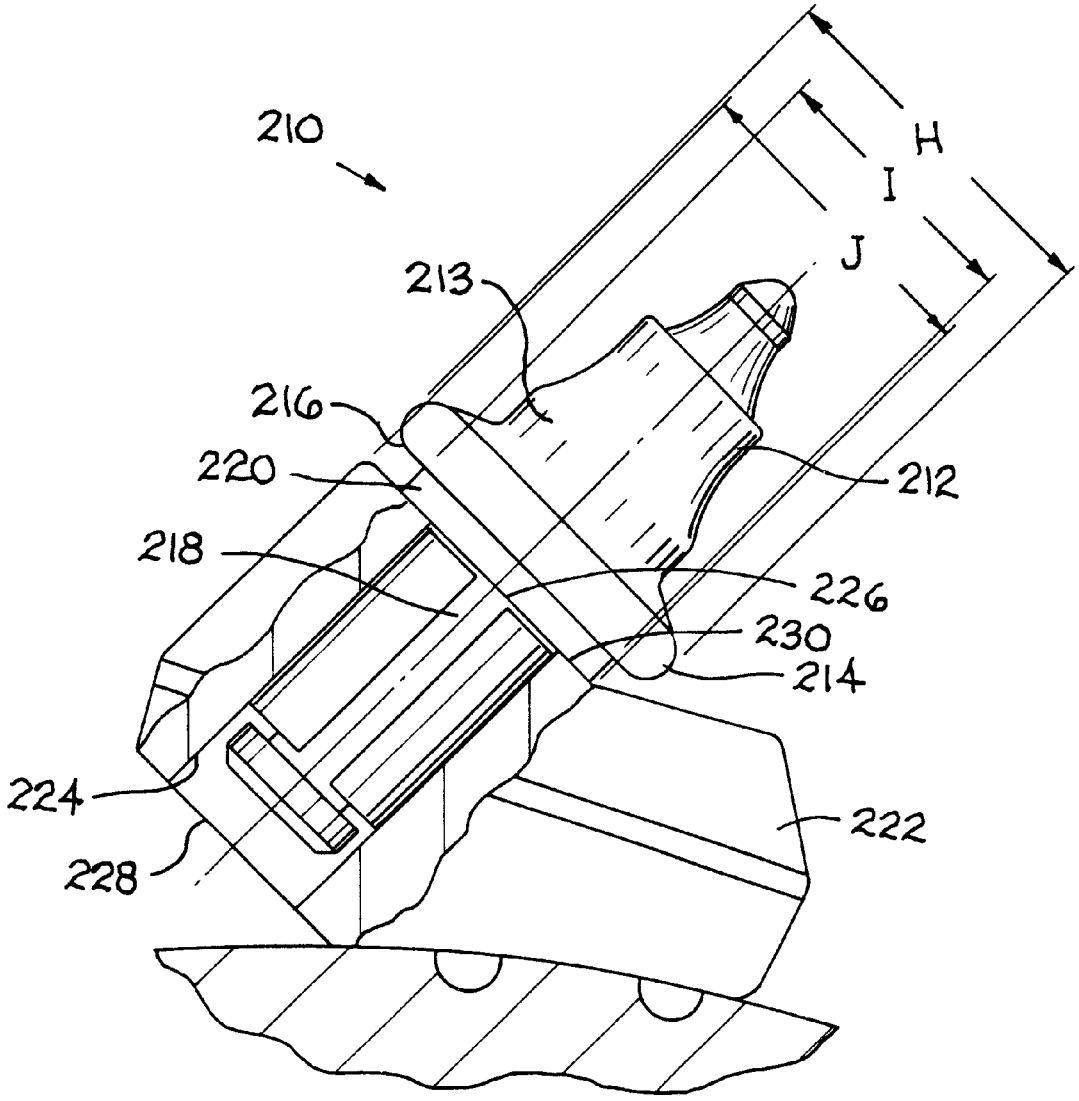
FIG. 8 is a side view of still another specific embodiment of a rotatable cutting tool-tool holder assembly wherein the cutting tool carries a washer.

Referring to FIG. 8, there is illustrated still another specific embodiment of the cutting tool-tool holder assembly generally designated as 210. Cutting tool-tool holder assembly 210 includes a rotatable cutting tool 212 that carries a washer wherein the cutting tool 212 is structurally like the cutting tool shown in FIG. 4. Cutting tool 212 has a cutting tool body 213 that includes a mediate enlarged dimension (i.e., diameter) portion 214 with a rearward facing surface 216 and a transverse dimension "H". The shank portion 218 of the cutting tool 212 carries the washer 220 in such a fashion that the washer 220 contacts the rearward facing surface 216 of the mediate enlarged dimension portion 214 of the cutting tool 212. The washer 220 has a transverse dimension "I". As shown in the specific embodiment of FIG. 8, the transverse dimension "H" of the enlarged dimension portion 214 is greater than the transverse dimension "I" of the washer 220.

Cutting tool-tool holder assembly 210 further includes a tool holder 222 which is structurally like the tool holder of the FIGS. 1 and 2, except that tool holder 222 does not contain a boss. The tool holder 222 includes a bore 224 that has a forward end 226 and a rearward end 228. The tool holder 222 includes a mating surface 230 adjacent to the forward end 226 of the bore 224. The mating surface 230 has a transverse dimension "J". In FIG. 8, the transverse dimension "J" of the mating surface 230 is greater than the transverse dimension "I" of the washer 220; however, it should be appreciated that these transverse dimensions, i.e., "I" and "J", may be equal. It is preferred that the transverse dimension "H" of the enlarged dimension portion of the cutting tool body be greater than each one of the transverse dimensions "I" and "J" of the washer and the mating surface, respectively. However, in some circumstances in which the transverse dimension "I" of the washer 220 is less than the transverse dimension "J" of the mating surface 230, then the transverse dimension "H" of the enlarged dimension portion of the cutting tool may be equal to or less than the transverse dimension "J" of the mating surface, and the transverse dimension "H" of the enlarged dimension portion of the cutting tool body may be greater than the transverse dimension "I" of the washer.

As illustrated in FIG. 8, when the cutting tool 212 is retained within the bore 224 of the tool holder 222, the washer 220 contacts the mating surface 230 of the tool holder 222 and the rearwardly facing surface 216 of the enlarged dimension portion 214 of the tool body. The advantages that exist for the specific embodiment of FIGS. 4–5 also exist for the specific embodiment of FIG. 8. In this regard, the washer 220 and the enlarged mediate dimension portion 214 function as barriers to the entry of debris into the bore 224 of the tool holder 222 and therefore protect the interface between the cutting tool and the tool holder. The rearwardly facing surface of the enlarged dimension portion also provides a lip that exposes a surface area. A force may be exerted against this lip surface area to assist in the removal of the cutting tool from the tool holder.

Overall, it is apparent that the present invention provides a rotatable cutting tool, as well as a rotatable cutting tool-tool holder assembly, that provides for improved rotational properties of the cutting tool. The shoulder of the cutting tool that extends radially outwardly past the mating surface (and the boss) of the tool holder functions as a barrier to the entry of debris into the bore of the tool holder. The boss, which surrounds the bore and projects from the top surface of the tool holder, also functions as a barrier to the entry of debris into the bore. In the case where the tool holder does not have a boss, the washer on the cutting tool surrounds the bore and functions as a barrier to the entry of debris into the bore.

The reduction in the amount of debris that enters the bore of the tool holder reduces the contamination of the interface between the cutting tool and the tool holder and enhances the ability of the cutting tool to consistently and effectively rotate during operation. It is also apparent that the present rotatable cutting tool and rotatable cutting tool-tool holder assembly provides for the enhanced ability to remove worn cutting tools from their respective tool holders with or without the access grooves in the boss such as is illustrated in FIG. 6.

All patents, patent applications and documents identified herein are hereby incorporated by reference herein.

Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. An assembly of a rotatable cutting tool and a tool holder, the assembly comprising:

a rotatable cutting tool including an elongate tool body;

the elongate tool body having an axially forward end and an axially rearward end, a longitudinal axis, an integral head portion adjacent to the axially forward end, an integral shank portion adjacent to the axially rearward end, and an integral enlarged dimension portion mediate of the head portion and the shank portion;

the enlarged dimension portion of the elongate tool body having a periphery and a rearwardly facing surface defining a generally planar shoulder;

the integral shank portion of the tool body carrying a washer so that the washer abuts against the rearwardly facing surface of the enlarged dimension portion of the elongate tool body;

the elongate tool body having a hard insert at the axially forward end thereof;

a tool holder comprising a tool holder body containing a bore having a forward end and a rearward end, and the tool holder body defining an integral mating surface surrounding the forward end of the bore, and the mating surface having a peripheral edge;

the shoulder having a first transverse dimension, the mating surface having a second transverse dimension, and the washer having a third transverse dimension;

the third transverse dimension of the washer being less than the second transverse dimension of the mating surface, the first transverse dimension of the shoulder being greater than or equal to the second transverse dimension of the mating surface, and the first transverse dimension of the enlarged dimension portion of the tool body being larger than the third transverse dimension of the washer; and the rotatable cutting tool being rotatably retained in the bore of the tool holder body so that the washer abuts against the mating surface of the tool holder body.

2. An assembly of a rotatable cutting tool and a tool holder, the assembly comprising:

a rotatable cutting tool including an elongate tool body;

the elongate tool body having an axially forward end and an axially rearward end, a longitudinal axis, an integral head portion adjacent to the axially forward end, an integral shank portion adjacent to the axially rearward end, and an integral shoulder;

wherein the shoulder is generally planar;

the integral shank portion of the tool body carrying a washer so that the washer abuts against the shoulder;

a tool holder defining an integral mating surface surrounding a bore, and the mating surface having a peripheral edge;

the shoulder having a first transverse dimension, and the washer having a third transverse dimension;

the first transverse dimension of the shoulder portion of the tool body being larger than the third transverse dimension of the washer;

the rotatable cutting tool being rotatably retained in the bore of the tool holder so that the washer abuts against the mating surface of the tool holder.

3. An assembly according to claim 2, wherein the mating surface has a second transverse dimension, the third transverse dimension of the washer being less than the second transverse dimension of the mating surface, the first transverse dimension of the shoulder being less than or equal to the second transverse dimension of the mating surface.

4. An assembly according to claim 3, wherein said washer has two generally planar surfaces.

5. An assembly according to claim 4, wherein said first transverse dimension is substantially larger than said third transverse dimension whereby to prevent fines from contaminating said holder.

6. An assembly according to claim 5, wherein said first transverse dimension is at least 5% larger than said third transverse dimension.

* * * * *